US007225495B2

(12) United States Patent
Berti et al.

(10) Patent No.: US 7,225,495 B2
(45) **Date of Patent: *Jun. 5, 2007**

(54) MOP WITH ATTACHED SCRUBBER

(75) Inventors: Enzo Berti, Venice (IT); Roberto Pellacini, Torrechiara (IT)

(73) Assignee: The Libman Company, Arcola, IL (US)

( * ) Notice: Subject to any disclaimer, the term of this patent is extended or adjusted under 35 U.S.C. 154(b) by 461 days.

This patent is subject to a terminal disclaimer.

(21) Appl. No.: 10/698,307

(22) Filed: Oct. 31, 2003

(65) Prior Publication Data

US 2004/0187240 A1 Sep. 30, 2004

Related U.S. Application Data

(63) Continuation-in-part of application No. 10/402,597, filed on Mar. 28, 2003, now Pat. No. 6,892,415.

(51) Int. Cl.
*A47L 13/12* (2006.01)

(52) U.S. Cl. ..... 15/116.2; 15/115; 15/118

(58) Field of Classification Search ..... 15/114, 15/115, 116.1, 116.2, 118, 119.2, 176.1, 176.4, 15/176.5, 176.6
See application file for complete search history.

(56) References Cited

U.S. PATENT DOCUMENTS

| | | | | |
|---|---|---|---|---|
| 701,657 | A | 6/1902 | Wilson | |
| 702,998 | A * | 6/1902 | Randolph | 15/115 |
| 2,472,781 | A * | 6/1949 | Vosbikian et al. | 15/146 |
| 2,534,086 | A * | 12/1950 | Vosbikian et al. | 15/245 |
| 2,730,741 | A * | 1/1956 | Gantz | 15/116.2 |
| 2,895,152 | A * | 7/1959 | Vosbikian et al. | 15/116.2 |
| 3,008,165 | A | 11/1961 | Scholl | |
| 3,050,761 | A | 8/1962 | Morgan | |
| 3,088,165 | A | 5/1963 | Bellis | |
| 3,167,799 | A * | 2/1965 | McKinley | 15/176.4 |
| 3,795,933 | A * | 3/1974 | Seufert | 15/114 |
| 3,806,982 | A * | 4/1974 | Park | 15/119.2 |
| 4,543,679 | A * | 10/1985 | Rosofsky et al. | 15/110 |
| D351,267 | S | 10/1994 | Libman | |
| D401,702 | S | 11/1998 | Berti | |
| 5,896,613 | A | 4/1999 | Courtney | |
| 6,336,240 | B1 | 1/2002 | Laux | |
| 2003/0136946 | A1 | 7/2003 | MacLean | |

FOREIGN PATENT DOCUMENTS

| | | |
|---|---|---|
| DE | 3834301 | 4/1990 |

* cited by examiner

*Primary Examiner*—Mark Spisich
(74) *Attorney, Agent, or Firm*—Banner & Witcoff, Ltd.

(57) ABSTRACT

A separate scrubber is securely attached to a mop that has a sponge mop element. The scrubber is attached to the mounting head with mounting stems. The mounting stems take the form of walls that are spaced at a distance apart. One or more of the walls has an outwardly facing ridge that extends from the wall by no more than half the distance between the walls. Each set of walls extends through an aperture on a mounting head, and the scrubber is held in place by the engagement of the ridges with a mounting face on the mounting head. The walls extend perpendicularly to the length of the body of the scrubber.

33 Claims, 3 Drawing Sheets

MOP WITH ATTACHED SCRUBBER

CROSS REFERENCE TO RELATED APPLICATIONS

This application is a continuation-in-part of application Ser. No. 10/402,597 titled "Mop with Attached Scrubber" filed on Mar. 28, 2003, now U.S. Pat. No. 6,892,415 issued on May 17, 2005.

BACKGROUND OF THE INVENTION

The present invention relates generally to mops, and more particularly to mops with attached scrubbers.

There are several different types of cleaning mops that have various mechanisms to squeeze out the water from the mopping surface, typically a sponge, during cleaning. Depending on the cleaning application, there may also be a need for these mops to have an additional scrubbing surface, such as a stronger or more abrasive cleaning surface like a brush. There are now several commercially available mops that have a scrubber in addition to the mopping surface. The addition of a scrubber gives the mop two different cleaning surfaces to allow the user to achieve the desired results.

Past attempts to manufacture a mop that has both a mopping element and a scrubber have encountered problems. It is difficult to fashion a mop that has both a mopping surface and scrubber that is constructed of one piece. This is because it is difficult to mold a mop with both features and then to staple the brush or bristles of a scrubber into the mop. Therefore, there is a need to securely attach the scrubber to the mop.

There is a need for a mop with a scrubber where the mopping surface and the scrubber are at the proper angle in relation to the mop handle for use. There is also a need for a mop that makes it easy for the user to switch between using the mopping element and the scrubber while using the mop.

In addition, there are often problems how the scrubber is attached to the head of the mop to achieve a securely attached scrubber. There is a need for a way to more securely engage the scrubber to the mop head so that the scrubber does not move around during use and so that the scrubber can withstand long periods of use.

Further, mopping surfaces, such as a sponge mop, can wear out after prolonged use, while scrubbers, such as a brush, typically can sustain longer periods of use. There is a need to have a mop that has a mopping surface that can be changed when desired by the consumer without affecting the scrubber.

BRIEF SUMMARY OF THE INVENTION

A separate scrubber and mopping element are securely attached together to form a mop that has two cleaning surfaces positioned at the appropriate angles for use relative to the handle. The scrubber is attached to the mopping element by engagement of a mounting stem that has a ridge with an opposing aperture defined in the mopping element.

One object of this invention is to overcome the disadvantages of previous mops by making a mop with both a mopping surface and a scrubber, where both the scrubber and the mopping surface are placed at the proper angles in relation to the handle for use.

It is another object of this invention to have a mop where the user can easily switch between using the mopping surface and the scrubber during use, and the scrubber does not interfere with the use of the mopping surface.

It is another object of this invention to overcome the previous disadvantages of the known methods of attaching the scrubber to the mop head, and to have a mop that has a securely attached scrubber.

It is yet another object of this invention to have a mop with a scrubber where the mopping surface can be easily changed by the user when desired.

A convenient new structure has been developed for attaching a scrubber to a mop. Like some previously known mops, a mop in accordance with the present invention has a handle and a mounting head that is connected to the handle. A sponge mop element is mounted on the mounting head. The mop also has a scrubber.

The scrubber is held to the mounting head by an engagement between a first wall and an aperture, and by an engagement with a second wall. A ridge on the first wall extends in one direction on a line between the two walls. There may also be a second ridge on the second wall that extends in the opposite direction.

Further advantages can be derived through the use of a separate mounting stem that is spaced at least about two inches away from the walls. The mounting stem can be used to engage a second aperture, providing more stability to the scrubber connection. Angling the mounting face on which the scrubber is mounted, and configuring the scrubber with a triangular configuration can also provide useful advantages.

BRIEF DESCRIPTION OF SEVERAL VIEWS OF THE DRAWINGS

The invention may be better understood by referring to the accompanying drawings, in which.

DETAILED DESCRIPTION OF THE INVENTION

Figure 1:
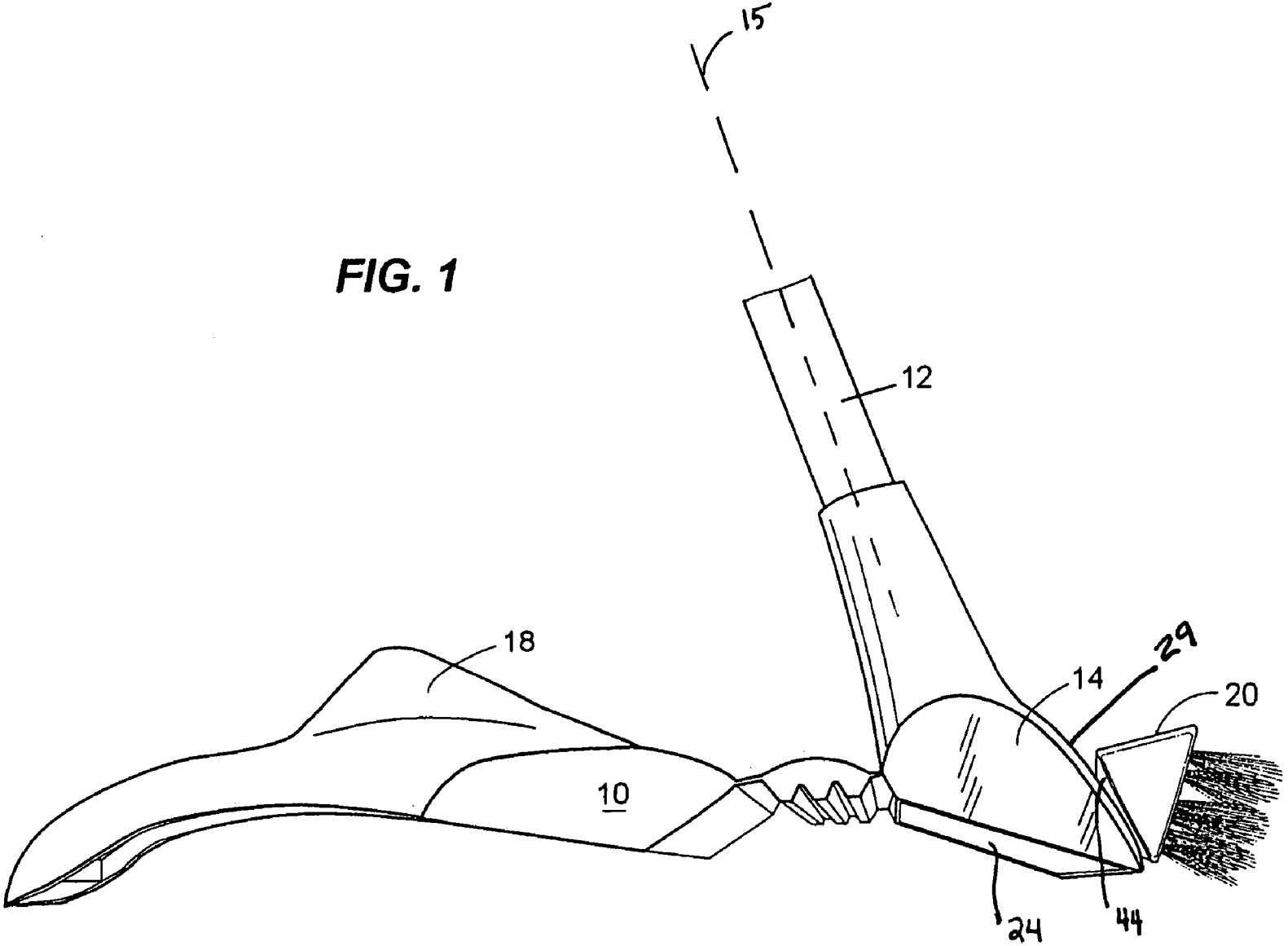
FIG. 1 is a perspective view of a mop with an attached scrubber in accordance with one embodiment of the invention.
Figure 2:
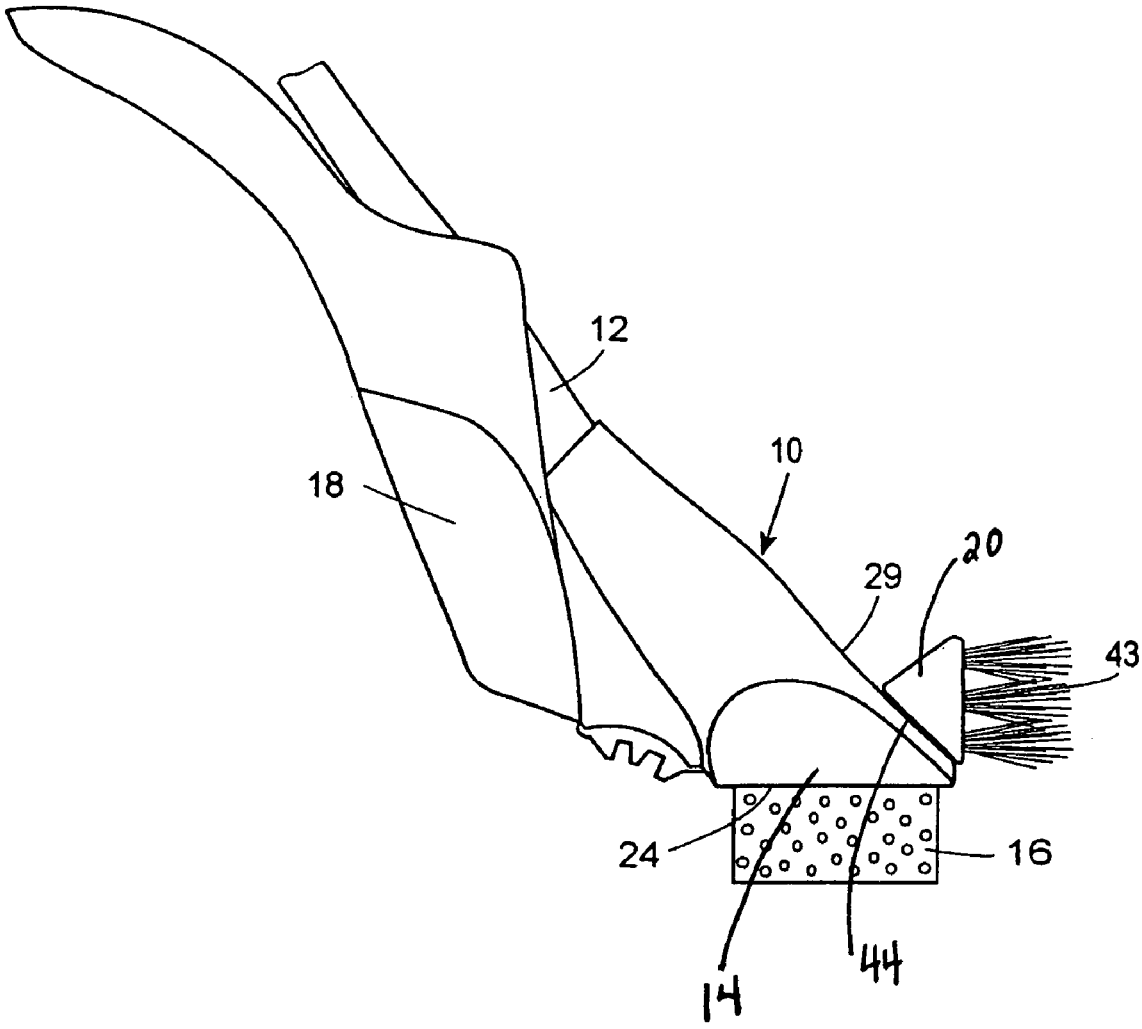
FIG. 2 is a side view of the mop seen in FIG. 1.

FIGS. 1 and 2 show one embodiment of a sponge mop 10 in accordance with the present invention. The illustrated sponge mop has a handle 12 and a mounting head 14 that is connected to the handle 12 in a conventional way. A sponge mop element 16 is attached to the mounting head 14. The mop has a scrubber 20 mounted on the mounting head 14. The handle 12 of the mop defines an axis 15. An optional moveable wringer plate 18 can be used to wring the sponge mop element 16. The optional wringer plate may be able to attach to the handle 12.

The illustrated mounting head 14 is made of molded plastic, but other materials may also be used. The illustrated sponge mop element 16 is also conventional. The mop element 16 may be attached to the bottom face 24 of the mop by any of several known methods. One such method is to include one or more sponge mop attachment prongs 32 on the bottom face 24 of the mop. One such means involves using the sponge mop attachment prongs 32 shown in FIG.

Figure 3:
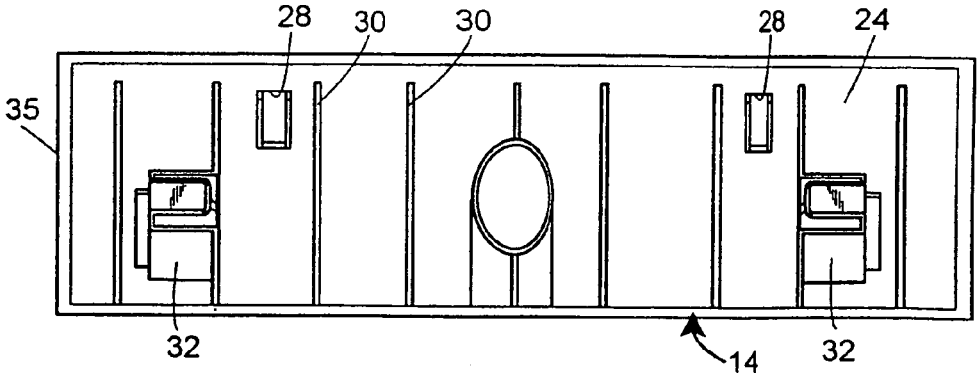
FIG. 3 is a plan view of a bottom face on the mop of FIG. 1, with the sponge mop element removed.

3. The illustrated attachment prongs 32 allow the sponge mop to be removed and replaced as desired. In one embodiment, the sponge mop element 16 has corresponding receivers to engage the attachment prongs 32. The sponge mop element 16 can be easily secured to the bottom face 24 of the mounting head 14 by engaging the attachment prongs into the corresponding receivers on the sponge mop element 16. In one embodiment as shown in FIG. 3, there are two attachment prongs 32 and two corresponding receivers on the sponge mop element. To engage the sponge mop element 16 with the bottom face 24 of the mounting head 14, one prong 32 is inserted into the corresponding receiver on the sponge mop element 16. To engage the second prong 32, it is necessary to outwardly bend the sponge mop element 16 so that the second prong 32 may be inserted into the second corresponding receiver in the sponge mop element 16. Similarly, the sponge mop element 16 may be detached from the bottom face 24 of the mounting head by outwardly bending the sponge mop element 16 so as to remove the prong 32 from the sponge mop element 16. Other arrangements of these elements could be used without departing from the scope of the present invention.

In the illustrated embodiment of the invention, the sponge mop element 16 is mounted to a bottom face 24 on the mounting head 14. In one embodiment, the bottom face 24 is disposed at an angle of about 60° with respect to the axis 15 of the handle 12. In another embodiment, the bottom face 24 is disposed at an angle of about 45° with respect to the axis 15 of the handle 12. This provides a convenient angle for mopping. Angles between about 30° to about 65° between the bottom face 24 and the axis 15 of the handle 12 are preferred, though other arrangements and angles may also be used. Further, in a preferred embodiment, the surface of the scrubber face 43 is disposed at an angle of about 60° with respect to the axis 15 of the handle 12. In another preferred embodiment, the surface of the scrubber face 43 is disposed at an angle of about 45° with respect to the axis 15 of the handle 12. Angles between about 30° to about 60° between the scrubber face 43 and the axis of length of the handle are preferred, though other angles may be used. In a preferred embodiment, the bottom face 24 is disposed at about a 90° angle from the scrubber face 43, though other angles may be used without departing from the scope of the invention.

FIG. 3 shows the bottom face 24 with the sponge mop element 16 removed. The illustrated bottom 24 face has two apertures 28 that pass through the mounting head 14 to a mounting face 29 on the opposite side. As seen in FIG. 2, the opposite side mounting face 29 is angled at an angle of approximately 45° with respect to the bottom face 24, and is roughly parallel to the axis or length of the handle 12. Although the use of two apertures 28 is believed to be preferable, the number of apertures 28 can vary. As illustrated, each aperture 28 is on an opposite end of the mounting head 14, about five inches apart. Preferably, for a conventionally sized sponge mop, the apertures 28 are spaced at least about two inches apart.

Figure 4:
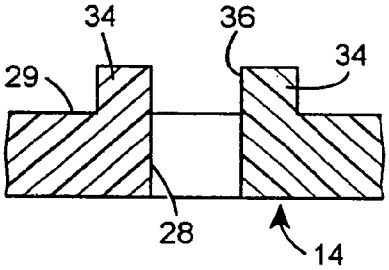
FIG. 4 is an enlarged fragmentary view of one of the apertures seen in FIG. 3.

As seen in FIG. 4, the illustrated apertures 28 are bounded on opposite sides by optional raised collar sections 34 that extend perpendicularly to the mounting face 29. The illustrated collar sections 34 extend parallel to the short edges 35 of the mounting head 14. The illustrated collar sections 34 are approximately 0.1 inches high, but can be higher or lower and may serve to provide strength. Preferably, the inside edges 36 of the collar sections 34 are straight and parallel.

Figure 5:
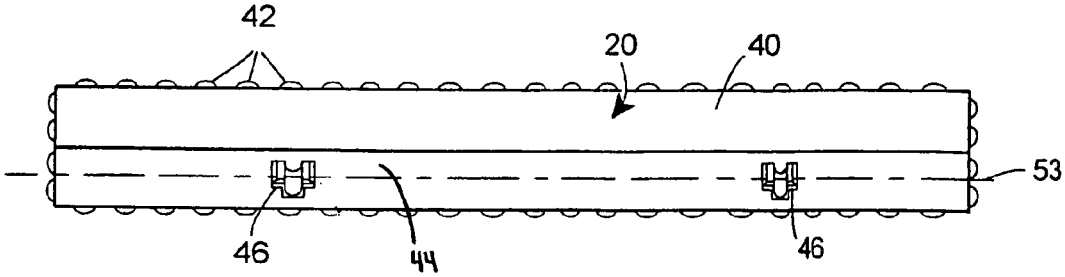
FIG. 5 is a top view of a scrubber on the mop seen in FIG. 1.

FIG. 5 shows the scrubber 20 used with the illustrated mop 10. The scrubber 20 has a body 40 that can be made of plastic or other suitable materials. The illustrated body 40 has a triangular cross section, with bristles 42 mounted on a scrubber face 43. An upper face 44 on the scrubber body provides a plane that lies against the mounting face 29 on the mounting head 14. Other arrangements of the scrubber 20 could also be used. The illustrated arrangement, however, is relatively easy to manufacture and provides a good way to attach the scrubber 20 to the mounting head at a convenient angle with respect to the handle 12. The illustrated scrubber 20 extends the entire length of the sponge mop, about nine inches, though any length of scrubber may be used. While a full-length scrubber is believed to be preferable, other lengths can also be used. Further, scrubbers of various widths may also be used.

The illustrated scrubber 20 includes two mounting stems 46 that are integrally molded on the upper face 44 of the scrubber. The mounting stems 46 are used for attaching the scrubber to the mounting head 14. While it is preferable for the number of mounting stems to match the number of apertures 28, this is not necessary. It is also preferable, but not necessary, that the mounting stems 46 be spaced at least about two inches apart, and closer to the lateral ends of the scrubber 20 than to the center. One or more mounting stems and apertures may be used to attach the scrubber.

The illustrated scrubber 20 has a triangular cross section, though other configurations and cross sections may be used. In this preferred embodiment, the triangular shaped scrubber is advantageous because, when the mounting stems 46 and the apertures 28 are engaged, the bristles of the brush 43 are properly positioned for easy use. The user of the mop can then easily switch between use of the mopping surface and the scrubber. A preferred scrubber has a cross-section that forms an isosceles triangle, where the bristles of the brush 43 are on the longest side of the triangle. This allows the bristles to be attached to the widest face of the scrubber, which allows the greatest area for brushes, or other scrubbing material.

Figure 6:
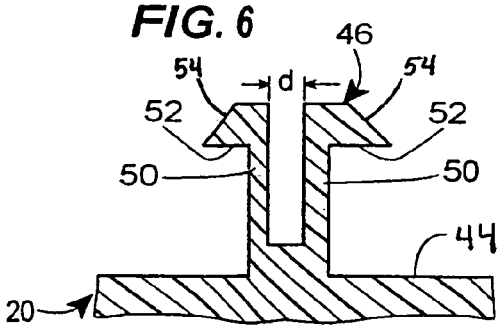
FIG. 6 is an enlarged fragmentary view of a mounting stem on the scrubber seen in FIG. 5.

The configuration of the mounting stems 46 can vary. An example of one of the illustrated mounting stems 46 is better seen in FIG. 6. There, the mounting stem 46 includes a pair of walls 50 that are spaced at a spacing distance "d" apart from each other. In the illustrated embodiment, each wall 50 is about 0.1 inches thick and about 0.25 inches high, though other heights and widths can be used. The two illustrated walls 50 may be spaced about 0.1 inches apart, and, when engaged, each extend generally parallel to the short edges 35 of the mounting head 14, and extend generally perpendicular to a line 53 between the two mounting stems 46. Preferably, the walls 50 are made of a resilient material such as deformable plastic. One of the ridges 52 on each mounting stem 46 extends to the left on the line between the walls, while the other ridge 52 extends to the right. In the illustrated embodiment of the invention, the ridges 52 extend out approximately 0.04 inches from the wall 50, though other lengths may be used. It is also preferable to have the outer edge 54 of the ridges 52 extend at an angle as shown in FIG. 6 to allow easier assembly. Arrangements and shapes other than those illustrated can be used, although it is preferable that the walls 50 be parallel and linear, and extend perpendicularly to the length of the body 40 of the scrubber 20.

In use, each set of walls 50 extends through and engages a corresponding aperture 28 to secure the scrubber 20 to the mounting head 14. Each of the illustrated walls 50 includes an outwardly extending ridge 52, the ridge extending from the wall 50 by no more than half the spacing distance. The illustrated arrangement of the walls 50 and ridges 52 enables the walls to be deflected inwardly so that the ridges 52 can pass through an aperture 28 during installation. To install and secure the scrubber 20 to the mounting head, the ridges 52 pass through the aperture 28. In this preferred embodiment, the angled outer edge 54 of the ridges 52 facilitate passing the ridges 52 through the aperture 28. As the ridges 52 pass through the aperture 28, the walls 50 deflect inwards. Once the ridge 52 passes through an aperture 28, the walls 50 return to their original position, and the ridges 52 engage the aperture 28 to effectively prevent the scrubber 20 from coming unattached from the mounting head 14. Preferably, the ridges 52 and walls 50 are elastic, in that after the ridges and walls passes through the aperture 28, they are capable of returning generally to their original shape and position to securely hold the brush in place.

Making the walls 50 straight permits the surface area contact of the ridges 52 to be maximized, while the necessary deflection distance of the walls 50 is minimized. Using apertures 28 that extend perpendicularly to the length of the body 40 may provide increased resistance to the scrubber 20 rolling along its axis, and spacing the apertures 28 far apart along the length of the body 40 may help to prevent pitch and yaw of the scrubber 20 on the mounting head 14. Further, while the scrubber is securely attached to the mounting head at an angle appropriate for use, the scrubber does not interfere with the mopping surface or with replacement of the mopping surface, if it is necessary.

While the walls 50 have been shown on the scrubber 20, and the apertures 28 have been shown on the mounting head 14, these relative positions could be reversed without departing from the intended scope of the invention. However, the illustrated arrangement may offer an additional benefit. Mounting the sponge mop element 16 on the bottom face 24 of the mounting head 14 covers the ridges 52, providing better aesthetics and reducing the chance of the ridges 52 becoming disengaged from the apertures 28 and causing the scrubber 20 to become unattached.

This description of one embodiment of the invention has been provided merely for illustrative purposes. The scope of the invention is set forth in the following claims.

The invention claimed is:

1. A mop comprising:

a handle;

a mounting head that is connected to the handle, the mounting head having a bottom face and a mounting face;

a mop element mounted on the bottom face of the mounting head;

a scrubber held to the mounting face by (a) an engagement between a first wall and an aperture, and (b) an engagement with a second wall; and (c) a ridge on the first wall extending in one direction on a line between the two walls; and the bottom face and the mounting face disposed at an acute angle with respect to each other.

2. A mop as recited in claim 1, in which the scrubber is at least about six inches in length.

3. A mop as recited in claim 1, in which the aperture has a linear side and the walls have parallel lengths.

4. A mop as recited in claim 1, in which the walls have parallel lengths that extend perpendicularly to the line between the walls.

5. A mop as recited in claim 1, in which the walls are spaced at least about two inches apart and engage separate apertures.

6. A mop as recited in claim 1, in which the two walls engage a single aperture.

7. A mop as recited in claim 1, in which the walls are integrally molded with scrubber.

8. A mop as recited in claim 1, in which the walls extend from a plane and the scrubber has a scrubber face that is disposed at about a 60° angle with respect to the plane.

9. A mop as recited in claim 1, in which the walls extend from a plane and the scrubber has a-scrubber face that is disposed at about 30° to about 65° angle with respect to the plane.

10. A mop as recited in claim 1, in which the bottom face and the mounting face are disposed at about an angle of about 60°.

11. A mop as recited in claim 1, in which the bottom face and the mounting face are disposed at about an angle of about 30° to about 65°.

12. A mop as recited in claim 1, in which the mounting face is approximately parallel to the length of the handle.

13. A mop as recited in claim 1, in which the scrubber has a body with two sides angled at approximately 60°.

14. A mop as recited in claim 1, in which the mop element covers the ridge.

15. A mop as recited in claim 1, in which the mop element is removable from the mounting head.

16. A mop as recited in claim 1, and further comprising a ridge on the second wall that extends in an opposite direction to the first ridge.

17. A mop as recited in claim 1, in which:

(a) the mop further comprises a ridge on the second wall; the walls engage a single aperture; and (b) the walls are separated by a distance that exceeds the sum of the widths of the ridges.

18. A mop comprising:

a handle;

a mounting head that is connected to the handle;

a mop element on a bottom face of the mounting head;

a pair of mounting stems, each mounting stem comprising a first and second wall, a ridge on the first wall extending away from the second wall, and a ridge on the second wall extending away from the first wall;

a scrubber held to a mounting face of the mounting head by engagements between the mounting stems and a pair of apertures; and the bottom face and the mounting face are disposed at approximately a 45° angle with respect to each other.

19. A mop as recited in claim 18, in which the mounting stems are spaced at least about 2 inches apart.

20. A mop as recited in claim 18, in which the distance between the walls of one of the mounting stems exceeds the sum of the widths of the ridges.

21. A mop as recited in claim 18, in which the walls on at least one of the mounting stems are deformable towards each other.

22. A snap assembled mop and scrubber construction comprising in combination:

a mop head element and a separate scrubber element with a uniform triangular cross-sectional profile attachable to the mop head element, said mop head element including a body with a handle attachment opening defining an axis, a scrubber element attachment face generally parallel to the axis defining one side of the mop head element, and a mop attachment face forming an acute angle to the axis and intersecting the scrubber element attachment face at said acute angle; and at least one scrubber element attachment passage in the mop head element between the faces; and said scrubber element including a mounting face with a projecting fastener for fitting through the attachment passage and including an attachment member for retaining the fastener in the passage with the mounting face against the scrubber element attachment face, said scrubber element further including a brush face extending at an acute angle from the mounting face.

23. The combination of claim 22 wherein the mop head element includes a sponge attachable to the mop head attachment face to cover the attachment passage and attachment fastener.

24. The combination of claim 23 wherein the sponge is detachable.

25. The combination of claim 22 wherein the faces of the mop head element and the scrubber element intersect at an angle in the range of 30° to about 65°.

26. The combination of claim 22 wherein the faces of the mop head element and the scrubber element intersect at an angle of about 45°.

27. The combination of claim 22 wherein the brush face and the mop attachment face intersect at about a 90° angle.

28. The combination of claim 22 wherein the uniform triangular cross-sectional profile of the scrubber element is defined by said mounting face, said brush face and a third connecting face thereof.

29. The combination of claim 22 wherein the scrubber element has a triangular cross-section that forms an isosceles triangle.

30. The combination of claim 22 wherein the fastener of the scrubber element comprises spaced elastic prongs with a projecting rib attachment member.

31. The combination of claim 22 where in the fastener of the scrubber element comprises first and second spaced fastener members, and said mop head element includes a passage for each fastener to attach the scrubber element to the mop head element.

32. The combination of claim 22 wherein the mop head includes a handle that is attached to the mop head at the handle attachment opening and defines an axis.

33. The combination of claim 22 where the mop head includes a wringer plate.

* * * * *